US005310099A

United States Patent [19]

Claas

[11] Patent Number: 5,310,099

[45] Date of Patent: May 10, 1994

[54] MANNEQUIN-TYPE CLOTHING DISPLAY ASSEMBLY COMPOSED OF RUBBERIZED ACRYLIC MATERIAL

[76] Inventor: Stephen J. Claas, 1255 Zephyr Ave., Hayward, Calif. 94544-7825

[21] Appl. No.: 969,954

[22] Filed: Nov. 2, 1992

[51] Int. Cl.[5] ..... A41H 5/00

[52] U.S. Cl. ..... 223/66; 223/68; 223/84

[58] Field of Search ..... 223/66, 68, 69, 84, 223/24; 206/292, 293, 28, 27; 211/70.1; 248/511, 176

[56] References Cited

U.S. PATENT DOCUMENTS

| | | | |
|---|---|---|---|
| 2,089,268 | 8/1937 | Kalvin | 223/68 |
| 2,127,368 | 8/1938 | Oestricher | 223/68 |
| 2,127,941 | 8/1938 | Rock | 223/68 |
| 2,481,561 | 9/1949 | Beall | 223/68 |
| 2,748,999 | 6/1956 | Freedman | 223/68 |
| 2,814,424 | 11/1957 | Wexler et al. | 223/68 |
| 2,948,445 | 8/1960 | Stoddard | 223/68 |
| 3,498,510 | 3/1970 | Johnson | 223/66 |
| 4,470,527 | 9/1984 | Middleton | 223/66 |
| 4,998,992 | 3/1991 | Richlin et al. | 223/66 |
| 5,063,259 | 11/1991 | Wanat et al. | 523/201 |

FOREIGN PATENT DOCUMENTS

| | | | |
|---|---|---|---|
| 484934 | 2/1975 | Australia | 223/66 |
| 593597 | 10/1947 | United Kingdom | 223/66 |

OTHER PUBLICATIONS

"Body Girl" Display Form Advertisement, Schamberger Presentation, Jun. 1, 1987.

Brochure entitled "IMPLEX® Impact Acrylic Sheet", Technical Manual.

*Primary Examiner*—Clifford D. Crowder

*Assistant Examiner*—Bibhu Mohanty

*Attorney, Agent, or Firm*—Flehr, Hobach, Test, Albritton & Herbert

[57] ABSTRACT

A mannequin-type display assembly (10) for modeling clothing ensembles which includes a body form (16) having a torso portion (20) and a pair of shoulder portions (22). Each shoulder portion (22) includes an upwardly facing shoulder top (24) and an outwardly facing shoulder end (26). The shoulder ends (26) are provided by a pair of flanges (28) extending downwardly from the shoulder top (24). The body form (16) is formed from a substantially planar sheet (14) of impact-resistant, rubberized, acrylic material which is permanently bent in a compound curve at the shoulder portions (22). The compound curve is provided by bending each of the shoulder tops (24) in a fore-and-aft direction and bending each of the flanges (28) in a downward and inward direction relative to the shoulder tops (24). The body form (16) may also include a head assembly (18) for displaying head wear.

12 Claims, 4 Drawing Sheets

MANNEQUIN-TYPE CLOTHING DISPLAY ASSEMBLY COMPOSED OF RUBBERIZED ACRYLIC MATERIAL

TECHNICAL FIELD

This invention relates to a novel assembly for displaying clothing. More specifically, this invention relates to a mannequin-type display assembly formed for modeling clothing ensembles in an aesthetically pleasing fashion.

BACKGROUND ART

Clothing shops oftentimes display mannequins in storefront windows and on the merchandise floor to model suggested clothing ensembles and to entice potential customers into the shop. The oldest and most common type of mannequin is molded from plaster in the form of a male or female figure. These plaster mannequins, however, are prone to break if mishandled or jostled, particularly at the mannequin appendages. Moreover, these mannequins are extremely expensive to manufacture and, thus, costly for the shop to acquire and replace, for example, at a cost of $200 to $400.

In the recent past, mannequin-type clothing displays have been designed from a plastic material, typically acrylic, in order to reduce costs associated with plaster mannequins. These plastic mannequins generally comprise a two-dimensional figure cut from a planar sheet of the plastic material in the form of a human figure. Some of these mannequin-type displays include pivotal arms and legs releasably attached to the plastic body form. The plastic body form is often colored to give the mannequin a trendy, abstract appearance. Although these plastic clothing displays are cost-effective ($40 to $60) and have a modernistic appeal, the two-dimensional figures lack a sufficient width dimension, particularly in the shoulder area, to allow clothes to hang properly. As a consequence, the clothes modeled on these display assemblies do not drape or hang well and develop undesirable creases and wrinkles, reducing the attractiveness and appealability of the modeled garment. An additional problem in connection with mannequin-type display assemblies is the provision of a three-dimensional head assembly or form. Again, plaster is well suited, but it is costly and fragile. Two-dimensional forms do not always display head wear to its best advantage. There is a need, therefore, for a relatively inexpensive three-dimensional head form or assembly for mannequins.

The difficulties suggested above are not intended to be exhaustive, but rather are among many which tend to reduce merchant satisfaction with prior mannequin-type display assemblies.

Accordingly, it is therefore a general object of the invention to provide a mannequin-type display assembly which will obviate or minimize difficulties of the type previously described.

It is a specific object of the invention to provide a mannequin-type display assembly which displays clothing in an aesthetically pleasing arrangement, without causing undesirable creases or wrinkles in the clothing.

It is still another object of the invention to provide a mannequin-type display assembly which resists breakage, particularly at the shoulder area, and is durable and nonflammable.

It is a further object of the invention to provide a mannequin-type display assembly which provides a unisex body figure for modeling men or women's clothing apparel.

It is yet a further object of the invention to provide a mannequin-type display assembly which is lightweight, is easy to mount to and dismount from clothing stands, and is relatively inexpensive to manufacture and maintain.

DISCLOSURE OF INVENTION

A preferred embodiment of the invention, which is intended to accomplish at least some of the foregoing objects, includes a body form having a torso portion and a pair of shoulder portions integrally formed with and extending from the upper end of the torso portion. Each shoulder portion includes an upwardly facing shoulder top and an outwardly facing shoulder end. The shoulder ends are provided by a pair of flanges extending downwardly and inwardly from the shoulder top. The body form is formed from a substantially planar sheet of impact-resistant, rubberized, acrylic material which is heated and permanently bent in a compound curve at the shoulder portions. The compound curve is provided by the bend at the shoulder tops in a fore-and-aft direction and the bend of each of the flanges in a downward and inward direction relative to the shoulder tops. Body form may also include a neck portion for mounting clothing display to a clothing stand, as well as a back portion, a hip portion, and a waist portion for modeling complete clothing ensembles. In addition, the body form preferably includes a three-dimensional head assembly. The head assembly is formed from a generally cylindrical foam portion which has a substantially oval-shaped cross section. The cylindrical foam member is securely mounted to a substantially oval base by a foam forming assembly or mechanism. The foam forming mechanism includes a pair of plate-like latching members and a pin extending transversely through an aperture in the latching members. The latching members are formed for positioning through longitudinal slots fashioned in both the foam member and the base. The pin remains oriented perpendicular to each slot. To form the head portion, the latching members are inserted through the slots in the foam member and the base until the latching members lock in place in the base slot, while the pin compresses, forms and contours the foam member into a substantially hemispherical shape.

BRIEF DESCRIPTION OF THE DRAWING

Other objects and advantages of the present invention will become apparent from the following detailed description of a preferred embodiment thereof taken in conjunction with the accompanying drawings.

BEST MODE OF CARRYING OUT THE INVENTION

Figure 1:
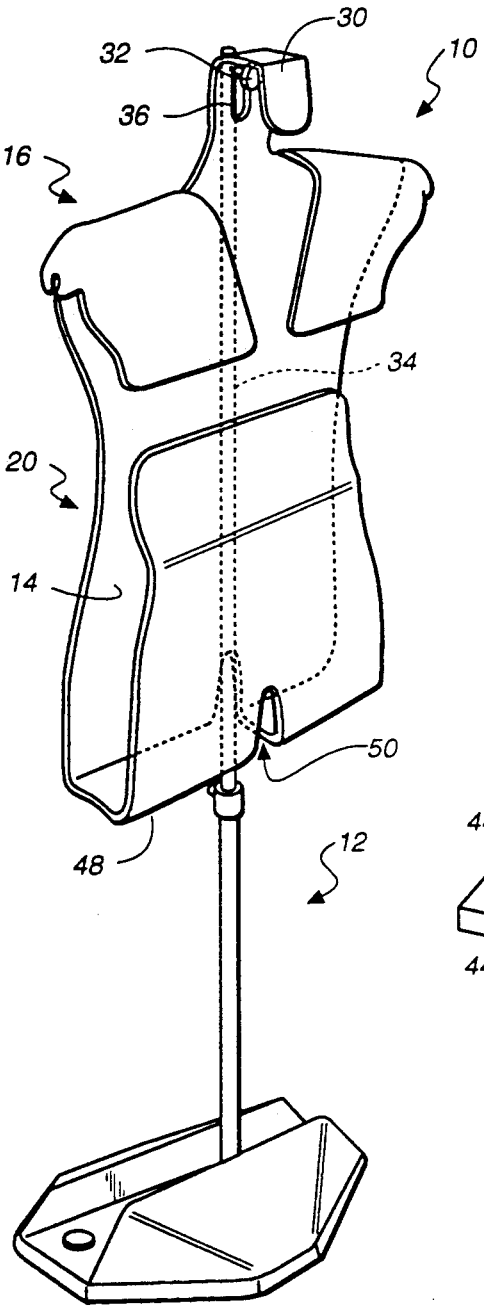
FIG. 1 is a front perspective view illustrating the subject mannequin-type display assembly mounted to an upright clothing stand in accordance with a preferred embodiment of the invention.

Referring now to the drawings, wherein like numerals indicate like parts, and initially to FIG. 1, there will be seen a mannequin-type clothing display assembly, generally indicated 10, mounted on a clothing stand, generally indicated 12, in accordance with a preferred embodiment of the invention. Clothing display assembly 10 is configured for attractively presenting clothing ensembles. Display assembly 10 is formed at relatively low cost from a substantially planar sheet 14 of impact-resistant, rubberized, acrylic material contoured to resemble a human figure.

Display assembly 10 is the result of an evolutionary design and testing process in which many design alternatives and material combinations were tried. The goal was a durable, low-cost, mannequin-type display that would support clothing in a realistic and flattering manner.

Forming the display assembly by bending plastic sheet material avoids the high production costs which would be associated with plastic molding processes. Applicant's first attempts at bending plastic sheets to provide mannequin-type displays which generally resembled a human torso resulted in undesirable creasing and wrinkling along the sleeve of the garment being modeled.

In response to this creasing and wrinkling problem, applicant conceived of a plastic mannequin-type display assembly, formed from a general-purpose acrylic sheet material, such as is sold under the trademarks ACRYLITE, PLEXIGLAS and LUCITE, having a compound curved shoulder area to allow garment sleeves to drape properly from the shoulders. The acrylic material sufficiently bent in a smooth curve at the shoulder; however, the shoulders frequently broke, particularly when grasped to lift the mannequin. In addition, if the display assembly was inadvertently dropped to the floor, which is predictable in light of its frequent handling, the shoulder often fractured or even broke off the torso portion, rendering the entire display assembly unusable. Numerous plastics and other shoulder designs were tested without success. For example, a well known high-strength plastic marketed under the trade name LEXAN provided sufficient strength to the shoulder area; however, when heat is applied and LEXAN is bent, water bonded into the plastic separates and forms unsightly bubbles under the heat.

In response to complaints about frequent breakage of the mannequin shoulders, applicant designed shoulders which were removably attachable to the torso portion by fasteners. Upon breakage, this shoulder assembly could be replaced, and the entire display assembly did not need to be discarded. However, constant replacement of the shoulders was costly and did not address the ultimate problem of structural weakness in the shoulder area of the display assembly.

In an effort to remedy these problems, applicant designed the mannequin-type display of the present invention which combines a unique sheet configuration and a unique sheet composition. This mannequin-type display is markedly stronger and more durable than prior displays. In addition, the shoulder area of the subject mannequin-type display assembly is designed to permit sweaters, blouses, and other shirt-type clothing to hang properly on the torso.

Figure 3:
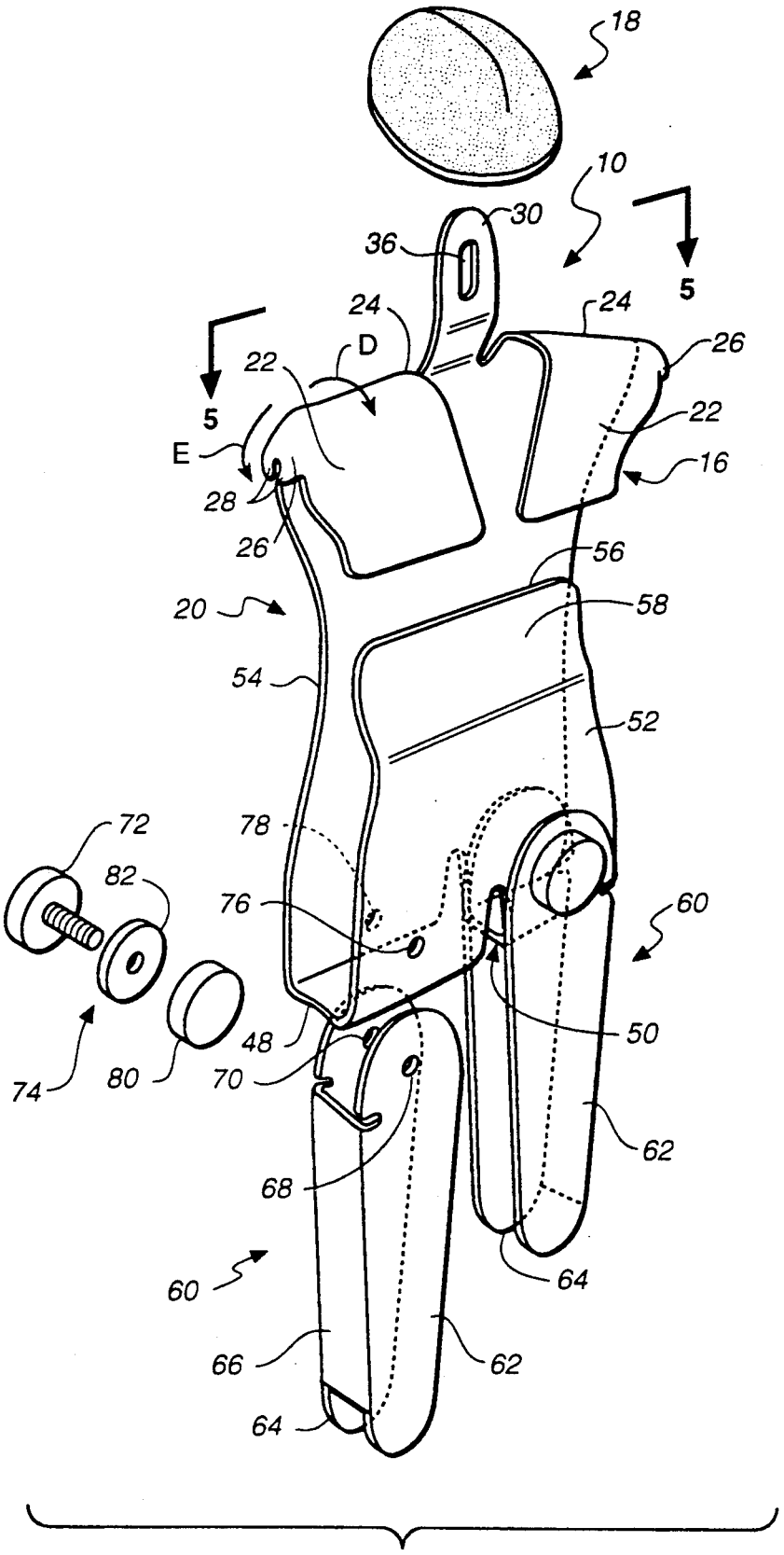
FIG. 3 is a partially exploded, side perspective view of the subject display assembly, including an enlarged view of a leg mounting device, in accordance with a preferred embodiment of the invention.

Turning to FIG. 3, a preferred embodiment of mannequin-type display assembly 10 generally includes a body form 16 and a head portion 18. Body form 16 primarily comprises a torso portion, generally indicated 20, and shoulder portions 22 which are integrally formed with an upper end of torso 20. Each shoulder 22 includes an upwardly facing shoulder top 24 and an outwardly facing shoulder end 26 contoured to support blouses, sweaters, and other shirt-type garments. Shoulder ends 26 are each provided by a pair of flanges 28 extending downwardly from respective shoulder tops 24 to create a smooth compound-curved surface for permitting clothes to drape properly, with no creasing, from the shoulder area of body form 16.

Figure 2:
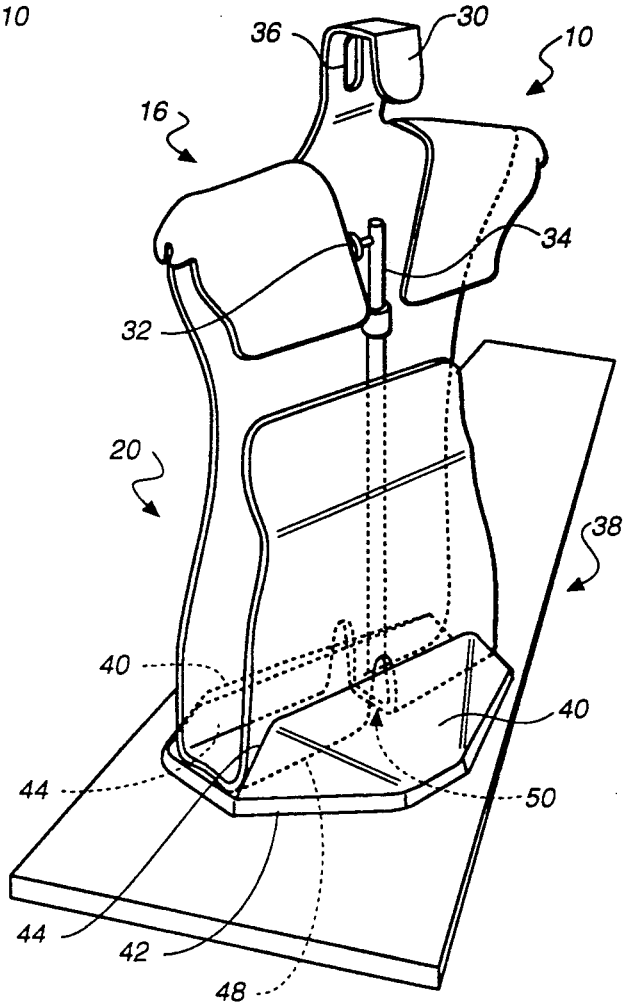
FIG. 2 is a front perspective view illustrating the subject mannequin-type display assembly mounted to a platform stand positioned on a counter top.
Figure 4:
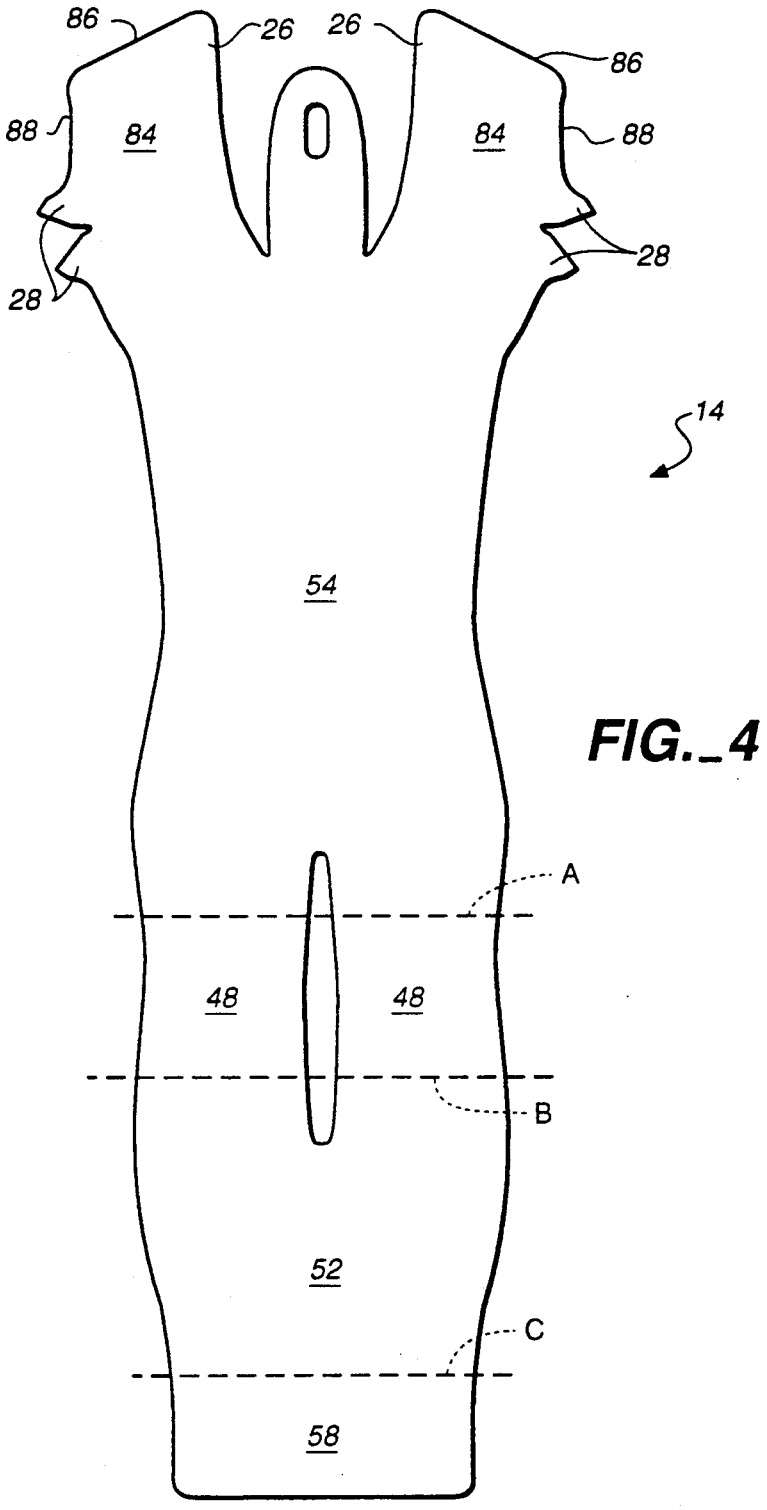
FIG. 4 is a top plan view of an unbent sheet for forming the body form of the subject invention.
Figure 5:
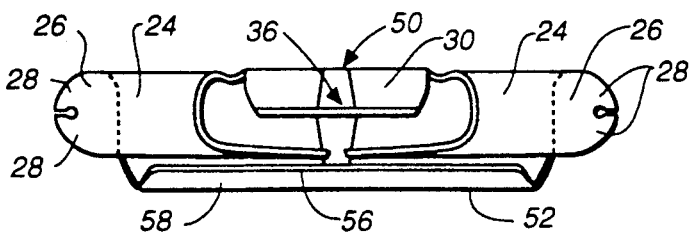
FIG. 5 is a top view of the display assembly of FIG. 3 as taken substantially along line 5—5.

Body form 16 further includes a neck portion 30 formed integrally with and extending away from the upper end of torso 20 between shoulders 22. Neck 30 may curve in an inverted U-shape toward torso 20, as shown in FIGS. 1 and 2, or may extend away from torso 20, as illustrated in FIGS. 3–5. To mount body form 16 on clothing stand 12 as seen in FIG. 1, a knob-like member 32 on collapsible pole 34 may be positioned through aperture 36 in neck portion 30. Alternatively, clothing display assembly 10 may be mounted on a platform stand, generally indicated 38, as illustrated in FIG. 2. Platform stand 38 has a pair of opposed side members 40 extending upward from a base 42. Side members 40 include side surfaces 44 which are spaced from each other a distance approximately equal to the width of lower end 48 of torso 20. Lower end 48 may be positioned between side surfaces 44 for stabilizing body form 16 in an upright position. In this alternative embodiment, pole 34 of clothing stand 12 may be collapsed down to a minimum height and then positioned through the longitudinal slot 50 in lower end 48 of torso 20.

Referring back to FIG. 3, lower end 48 of torso 20 includes a hip portion 52 and a back portion 54. Hip 52 is oriented essentially parallel to and spaced from back 54 to form a lower torso for modeling pants, shorts, skirts, and the like. In addition, an upper end 56 of hip 52 may be bent inward and toward back 54 to form a waist portion 58. Pants, or any other clothing adorning lower end 48 of torso 20, may be cinched at waist 58 by a belt, sash, or any other accessory. The relative dimensions of shoulder tops 24, shoulder ends 26, waist 58, back 54, and hip 52 may be seen in FIG. 5, although it is to be understood that these dimensions may be modified, depending upon the clothes being displayed.

In another aspect of the invention, leg portions, generally indicated 60, may be removably mounted to hip 52 and back 54. Legs 60 include a front panel 62 and a back panel 64 adjoined by a side panel 66. Apertures 68 and 70 extend through front and back panels 62 and 64, respectively, for receiving a pin-like connecting element 72 of a leg mounting device, generally indicated 74. Apertures 76 and 78 corresponding to those fashioned through front panel 62 and back panel 64 extend through hip 52 and back 54, respectively. Leg mounting device 74 preferably includes connecting element 72 and a receiving element 80, separated by a washer 82, although other mounting devices may suffice. To mount a leg 60 to lower end 48 of torso 20, a pin-like connecting element 72 is positioned through apertures 68 and 76, and a receiving element 80, separated from connecting element 72 by a washer 82 is tightened around the pin, securing leg 60 to hip 52. Following the same series of steps, another leg mounting device 74 is positioned through apertures 70 and 78 to rigidly secure leg 60 to back 54. Once mounted, leg 60 extends downward from lower end 48 of torso 20 in substantially vertical alignment with torso 20.

Turning to FIG. 4, a preferred embodiment of sheet 14 suitable for forming body form 16 of display assembly 10 is shown. In order to provide the necessary resistance to fracture and shattering, while allowing bending about mutually perpendicular axes without creasing, discoloring or the like, sheet 14 is formed from an impact-resistant, rubberized, acrylic material, such as the type marketed under the trade name IMPLEX Impact Acrylic Sheet. This material is significantly tougher than general-purpose acrylic sheet material and provides excellent resistance to breakage. In addition, the rubberized acrylic material maintains its clear transparency and does not yellow over time, and the IMPLEX material is nonflammable. It was thought that rubberized acrylic would not be a good choice because the body form edges are usually flame-polished as part of the manufacturing process. The rubber in the acrylic, however, does not discolor or burn during flame-polishing.

Addressing the preferred configuration of sheet 14, shoulders 22 of body form 20 are provided by generally rectangular panels 84 each having a first end, integrally formed with upper end of torso 20, and an opposed second end 86 extending away from torso 20. Flanges 28 extend outwardly from a first side 88 of each shoulder 26 in a substantially V-shape. Back 54 extends from upper end of torso 20 to an imaginary transverse line labeled A. The area between imaginary lines A and B defines lower end 48 of torso 20. Hip 52 of torso 20 is bounded by imaginary lines B and C, and waist 58 is represented by the area between end 56 and imaginary line C. The edges of sheet 14 are preferably flame-polished smooth to provide a finished look to the display assembly 10.

Sheet 14 may be heated and then permanently bent along the imaginary lines A, B and C shown in FIG. 4 to provide the final configuration of the lower end of the torso. More importantly, the configuration of sheet 14 advantageously permits formation of a compound curve in the shoulder area of body form 20. Shoulder tops 24 of body form 20 are created by heating and then bending shoulder panels 84 until shoulder panels 84 extend substantially parallel and in spaced relation to back 54. Flanges 28 on each shoulder 26 are then bent downward and inward relative to shoulder tops 24 to form shoulder ends 26. The compound curve is provided by the bend at each shoulder top 24 in a fore-and-aft direction, indicated by the arrow D in FIG. 3, and by the downward and inward bend of flanges 28, illustrated by arrow E. Shoulder tops 24 and shoulder ends 26 are highly resistant to shattering and breakage due to the use of an impact-resistant, rubberized, acrylic sheet material to form the display. Moreover, the smooth curvature at the shoulders of body form 16 prevents creasing and undesirable wrinkling of garment sleeves. Thus, the configuration and composition of heat-deformable sheet 14 permits formation of a compound curve at the shoulder area of body form 16, which both smoothly drapes the garment sleeve attractively over the shoulder and effectively resists structural failure.

In addition to body form 16, clothing display assembly 10 also may include a head assembly 18, as illustrated in FIG. 3, for modeling hats, caps, and other head wear. Focusing on FIG. 6, head 18 preferably includes an oval base 90 and a generally cylindrical foam member 92, having an oval transverse cross section. Base 90 and foam member 92 each include longitudinal slots 94 and 96, respectively, for receiving a head forming mechanism, generally indicated 98. Head forming mechanism 98 may be inserted through slots 94 and 96 to contour foam portion 92 into a substantially hemispherical shape. Mechanism 98 also secures foam member 92 to base 90, but adhesive is typically employed to bond these two members together. Head 18, which is absent any facial features, may function as a male or female model because of its unisex design, as is also true for body form 20. Head 18 may be constructed in different sizes to represent men, women, or children; however, the overall configuration remains the same.

Figure 9:
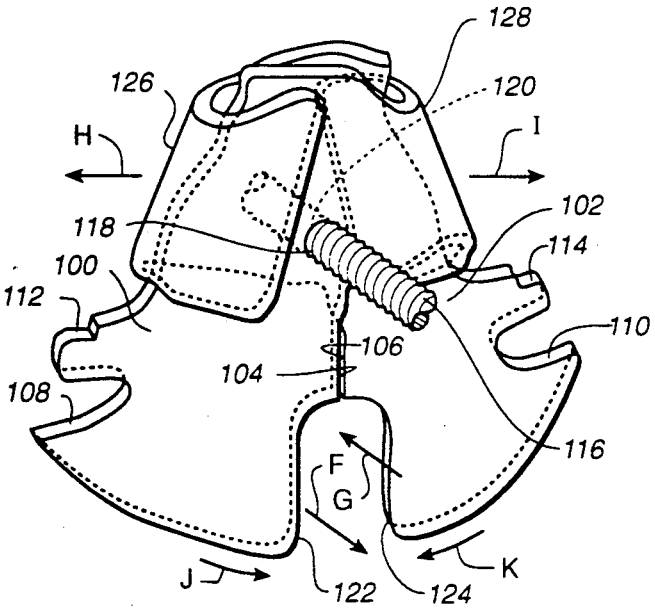
FIG. 9 is an enlarged, front perspective view of the plate-like latching members of the foam forming and mounting mechanism of FIG. 7.
Figure 10:
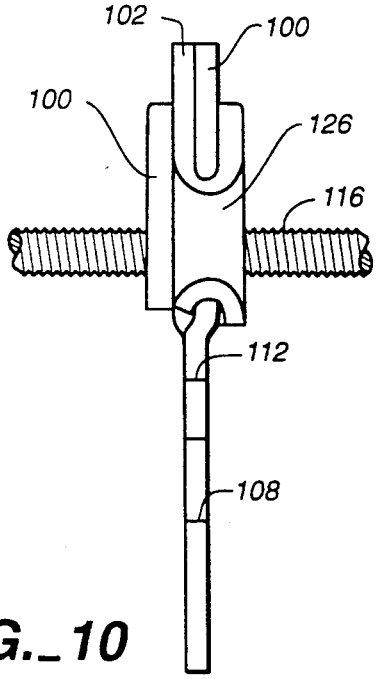
FIG. 10 is an enlarged, fragmentary, side elevation view of the mounting mechanism of FIG. 7.

Mounting mechanism 98 includes a pair of plate-like latching members 100 and 102, as seen most clearly in FIGS. 9 and 10. Latching members 100 and 102 are independently formed and may be completely separated by moving latching members 100 and 102 in the direction of arrows F and G, respectively, as indicated in FIG. 9, until surfaces 104 and 106 on members 100 and 102, respectively, are displaced from one another, and then sliding members 100 and 102 away from each other in the direction of arrows H and I. In a preferred embodiment, however, latching members 100 and 102 remain intertwined to serve as a locking mechanism for securing foam member 92 to base 90 and forming member 92 into a hemisphere.

Figure 7:
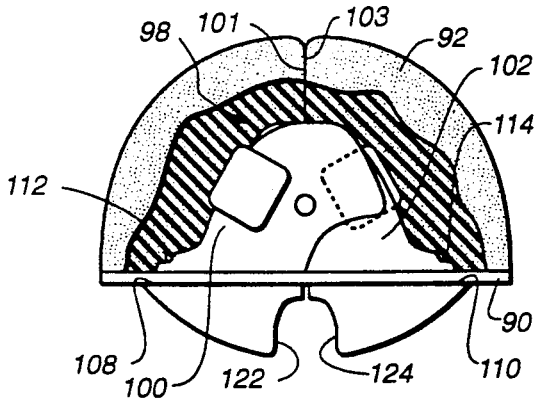
FIG. 7 is a front elevation view, partially broken away, of the head portion of the subject invention.
Figure 8:
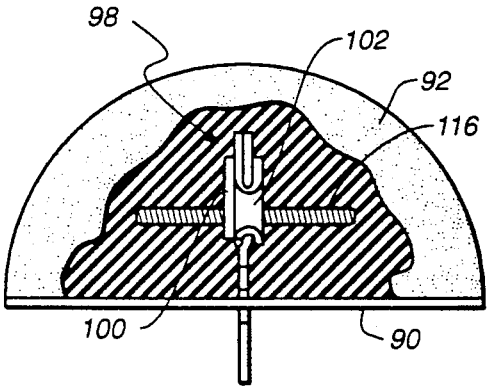
FIG. 8 side elevation view, partially broken away, of the head portion of the subject invention.

To operate as a lock, latching members 100 and 102 each include a shoulder 108 and 110, respectively, for releasably locking latching members 100 and 102 in place in base slot 94, as illustrated in FIGS. 7 and 8. A second shoulder 112 and 114 is formed on each latching member 100 and 102, respectively, to temporarily lock members 100 and 102 in slot 94 and exert stronger compressive forces on foam member 92 than those provided by shoulders 108 and 110. Mounting mechanism 98 also includes a threaded bolt or pin 116 for positioning through apertures 118 and 120 in latching members 100 and 102. Latching members 100 and 102 are mounted for pivotal movement about pin 116 over a fixed angular distance, as well as for movement in an axial direction with respect to pin 116. During pivotal movement, each latching member 100 and 102 rotates about pin 116 in an opposite direction from the other. The axial and rotational motion of latching members 100 and 102 enables mounting of foam member 92 to base 90, as will now be described.

Figure 6:
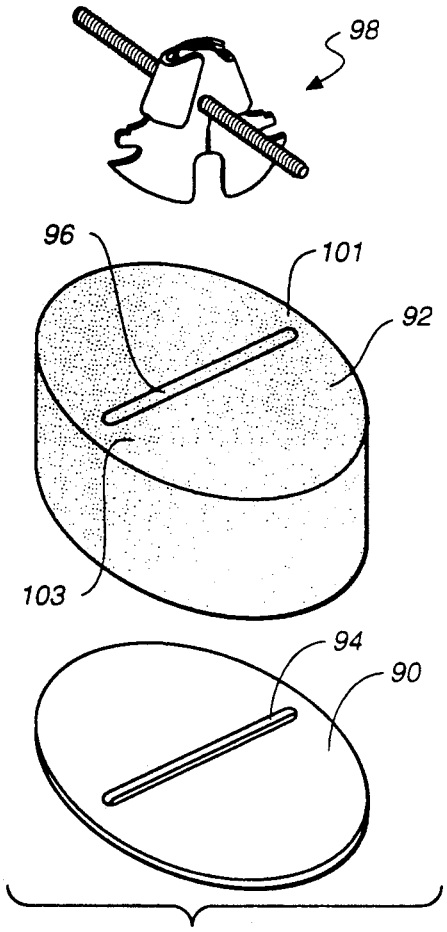
FIG. 6 is an exploded view of a head portion of the subject display assembly in accordance with a preferred embodiment of the invention.

To assemble foam member 92 to base 90, an adhesive paste or coating is spread on base 90, and cylindrical foam member is positioned on base so that slots 94 and 96 are in alignment. Next, latching members 100 and 102 are axially displaced with respect to pin 116 in the direction of arrows F and G. Latching members 100 and 102 then are pivoted about bolt or pin 116 towards each other, as indicated by arrows J and K, to slightly decrease the width of mounting mechanism 98. Decreasing the width dimension better enables mounting mechanism 98 to be positioned through slots 96 and 94 in foam member 92 and base 90, respectively. As mounting mechanism 98 is inserted from the top of foam member 92 toward base 90 through slots 96 and 94, the bolt or pin 116 remains perpendicular to the slots, causing the foam surrounding pin 116 to compress in a downward and inward direction. Mounting mechanism 98 is inserted through slots 96 and 94 to a position where shoulders 112 and 114 may be latched in place in base slot 94. Latching of shoulders 112 and 114 is achieved by pivoting members 100 and 112 about pin 116 in the reverse direction of arrows J and K. While shoulders 112 and 114 are in place, pin 116 and latching members 100 and 102 tightly compresses foam opposite sides 101 and 103 of the foam member's upper surface together as well as compressing member 92 against base 90. This allows adhesive securement of foam member 92 to base 90, and adhesive securement of surface of foam member 92 (FIGS. 6 and 7). Once the adhesive has dried between opposite sides 101 and 103 of the upper surface of foam member 92, latching members 100 and 102 can be axially displaced relative to slots 94 and 96 in an outward direction to latch assembly 98 to base 90 by means of shoulders 108 and 110, as shown in FIG. 7. In this position, pin transverse bolt 116 maintains sufficient compression on foam member 92 that such compression and the adhesive maintain foam member 92 in a substantially hemispheric shape to create head 18.

Latching members 100 and 102 each include a gripping surface 122 and 124, respectively, resiliently biased toward each other by foam member 92 to enable releasable attachment of head 18 to a clothing stand. By pivoting latching members 100 and 102 about pin 116 away from each other, surfaces 122 and 124 may be slightly spaced from each other and positioned around a cylindrical rod on a clothing display. In a normal resting position, as seen in FIG. 7, surfaces 122 and 124 are biased towards each other by the downward force exerted by foam member 92 on sloped surfaces 126 and 128 of latching members 100 and 102, respectively.

It is to be understood that the subject mannequin-type display assembly may be constructed in various sizes, depending on the particular clothing being modeled. In addition, the display assembly may be configured with more curvature at the waist, or alternatively, little curvature, to more closely resemble the figure of a woman, or a man. The same applies to other areas of curvature of the body form of the subject invention.

In describing the invention, reference has been made to a preferred embodiment and illustrative advantages of the invention. Those skilled in the art, however, and familiar with the instant disclosure of the subject invention, will recognize additions, deletions, modifications, substitutions, and other changes which will fall within the purview of the subject invention and claims.

What is claimed is:

1. A mannequin for the display of clothing comprising:

a substantially planar single sheet of thermoplastic material having a frontal shape simulating a human torso and permanently formed by heating and bending into a three-dimensional body form including a torso portion having an upper end with a pair of shoulder portions integrally formed with and extending from said upper end, each of said shoulder portions including an upwardly facing transversely extending arcuate shoulder top and an outwardly and downwardly facing smooth arcuate shoulder end, each said shoulder end being provided by a pair of flanges extending downwardly in a smooth arcuate surface from said shoulder top and defining a vertically extending slot therebetween, said flanges forming a compound curve with said shoulder top, said compound curve being provided by a bend of said sheet in a fore-and-aft direction providing said shoulder top and a downward bend of each of said flanges in a direction transverse to said shoulder tops to provide said smooth arcuate shoulder end.

2. A mannequin-type display assembly as defined in claim 1 wherein, said thermoplastic sheet is a rubberized acrylic material; and prior to bending, said flanges extending outwardly from a first side of each of said shoulder portions in a substantially V-shape.

3. A mannequin for the display of clothing comprising:

a substantially planar sheet of impact-resistant, rubberized, acrylic material permanently formed by bending into a three-dimensional body form;

said body form including a torso portion having a U-shaped lower end with said sheet being bent in a fore-and-aft direction and bent upwardly to provide a hip portion and a rearwardly spaced and substantially parallel back portion;

said torso portion further having a U-shaped upper end formed to provide a pair of shoulders each including a shoulder top bent in a fore-and-aft direction and bent downwardly, and a pair of end flanges bent in a downward direction transverse to said shoulder top to form a compound curve with said shoulder top; and a head portion including a substantially oval-shaped sheet providing a base member, a generally cylindrical foam member mounted on said base member and extending upwardly therefrom, said foam member having a substantially oval cross section parallel to said base member, said foam member and said base member each including a slot therethrough, and a foam forming assembly mounted in engagement with said foam member and including a pair of plate-like latching members extending down through said slot in said foam member to engage base member, and a pin extending perpendicularly through said latching members and outwardly of said latching members to engage said foam member on both sides of said slot, said latching members mounted for pivotal movement about said pin to latch said pin to said base member in a position pulled down in said slot against said foam member to thereby form said foam member into a substantially hemispherical shape on said base member.

4. A mannequin display as defined in claim 3 wherein, said foam forming assembly includes a pair of plate-like latching members having a pin extending perpendicularly therethrough a substantial distance beyond both sides of said latching members, said foam member and said base member each being formed with a slot extending transverse to the longitudinal axis of said oval sheet providing said base member, said latching members positioned through said slot and said pin being mounted to extend perpendicularly with respect to said slot, said latching members locking in place in said slot in said base, and said pin engaging said top surface and compressing and contouring said foam member into said substantially hemispherical shape.

5. A mannequin display as defined in claim 4 wherein, each of said latching members includes a first shoulder means for positioning through said slot in said foam member and said slot in said base member to releasably lock said latching members in place in said slot in said base member.

6. A mannequin display as defined in claim 5 wherein, each of said latching members includes a second shoulder means for positioning through said slot in said foam member and said slot in said base member to temporarily lock said latching members in place so that said latching members and said pin compress said foam member against said base member to effect adhesive securement of opposite sides of said top surface of said foam member.

7. A mannequin as defined in claim 3 wherein, each of said latching members pivots about said pin in an opposite direction from the other of said latching members, and said latching members are formed to pivot away from and toward each other over a fixed angular distance.

8. A mannequin as defined in claim 7 wherein, each of said latching members includes a first shoulder means for positioning through said longitudinal slot in said foam member and said longitudinal slot in said base member to releasably lock said latching members in place in said longitudinal slot in said base member.

9. A mannequin as defined in claim 8 wherein, each of said latching members includes a second shoulder means for positioning through said longitudinal slot in said foam member and said longitudinal slot in said base member to temporarily lock said latching members in place so that said latching members compress said foam member against said base member to effect adhesive securement of said opposite sides of said top surface of said foam member.

10. A mannequin as defined in claim 9 wherein, said forming assembly further includes opposed gripping surfaces resiliently biased toward each other to enable releasable attachment of said head portion to a clothing stand for displaying clothes.

11. A mannequin for the display of clothing comprising:

a substantially planar sheet of impact-resistant, rubberized, acrylic material permanently formed by bending into a three-dimensional body form;

said body form including a torso portion having a U-shaped lower end with said sheet being bent in a fore-and-aft direction; and said torso portion further having a U-shaped upper end formed to provide a pair of shoulders each including a shoulder top bent in a fore-and-aft direction and bent downwardly, and a pair of spaced apart flanges bent in a downward direction transverse to said shoulder top to form a compound curve with said shoulder top.

12. A head assembly for a mannequin comprising:

a substantially oval sheet providing a base member;

a resiliently compressible foam member positioned on top of said base member and extending upwardly therefrom to an upwardly facing top surface, said foam member having a substantially oval cross section in a plane parallel to said base member; and a foam forming assembly engaged against said top surface of said foam member and extending down through and coupled to said base member to compress said top surface down toward said base member until opposed side surfaces of said foam member are deformed toward each other by an amount producing a substantially hemispherical shape of said foam member on said base member.

* * * * *